US009058948B2

(12) United States Patent
Grosjean

(10) Patent No.: US 9,058,948 B2
(45) Date of Patent: Jun. 16, 2015

(54) MEDIUM-VOLTAGE SWITCHGEAR DEVICE COMPRISING A VACUUM CARTRIDGE

(75) Inventor: Patrice Grosjean, Varennes Saint Sauveur (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 486 days.

(21) Appl. No.: 13/337,509

(22) Filed: Dec. 27, 2011

(65) Prior Publication Data

US 2012/0187090 A1 Jul. 26, 2012

(30) Foreign Application Priority Data

Jan. 25, 2011 (FR) ..... 11 50576

(51) Int. Cl.
*H01H 33/666* (2006.01)
*H01H 33/12* (2006.01)

(52) U.S. Cl.
CPC ..... *H01H 33/6661* (2013.01); *H01H 33/126* (2013.01)

(58) Field of Classification Search
CPC . H01H 33/66; H01H 33/6661; H01H 33/126; H01H 33/666; H01H 66/6667
USPC ..... 218/7, 8, 10, 14, 118–121, 140, 153, 218/154
See application file for complete search history.

(56) References Cited

U.S. PATENT DOCUMENTS

| | | | | |
|---|---|---|---|---|
| 5,155,315 | A * | 10/1992 | Malkin et al. | 218/3 |
| 5,243,159 | A | 9/1993 | Demissy | |
| 5,280,144 | A * | 1/1994 | Bolongeat-Mobleu et al. | 218/70 |
| 5,347,096 | A * | 9/1994 | Bolongeat-Mobleu et al. | 218/84 |
| 5,591,948 | A | 1/1997 | Bolongeat-Mobleu et al. | |
| 7,534,976 | B2 * | 5/2009 | Crutcher | 218/120 |
| 2010/0102035 | A1 | 4/2010 | Piccoz et al. | |

FOREIGN PATENT DOCUMENTS

| | | |
|---|---|---|
| EP | 2 182 536 A1 | 5/2010 |
| FR | 2 675 304 | 10/1992 |
| FR | 2 721 434 | 12/1995 |
| FR | 2 937 786 | 4/2010 |
| WO | WO 2010/136424 A1 | 12/2010 |

* cited by examiner

*Primary Examiner* — Amy Cohen Johnson
*Assistant Examiner* — Marina Fishman
(74) *Attorney, Agent, or Firm* — Steptoe & Johnson LLP

(57) ABSTRACT

A current breaking device including a main stationary contact; a vacuum cartridge connected to the main contact and, having a rod supporting a second movable contact for connection with a second stationary contact on the main contact; a main movable contact for connection with, the main stationary contact; and a rigid rocker arm pivotally connected to the actuating rod of the vacuum cartridge, and about another axis fixed with respect to the main stationary contact and vacuum cartridge, so that upon rotation of the rocker arm to open both the main and second contacts, the main contacts are opened before the second contacts, and upon rotation in the opposite direction the second contacts are fully closed before any movement of the main contacts toward closure.

12 Claims, 8 Drawing Sheets

MEDIUM-VOLTAGE SWITCHGEAR DEVICE COMPRISING A VACUUM CARTRIDGE

BACKGROUND OF THE INVENTION

The object of the invention is an electric switch or circuit breaker, in particular suitable for medium voltage, and comprising a vacuum cartridge. The term "medium voltage" (MT) is used in its usual acceptation, i.e. for a voltage that is greater than 1000 volts in alternating current and greater than 1500 volts in direct current but which does not exceed 52,000 volts in alternating current and 75,000 volts in direct current.

STATE OF THE ART

Such apparatuses have to perform breaking and isolation of electric circuits. Their base element is a main movable contact on the electric circuit so as to have a closed state and an open state of the circuit. Breaking of the circuit can however be problematic on account of the occurrence of an arc passing through the movable contact even when the latter has been opened. Vacuum cartridges branch-connected to the main contact are therefore often added so as to make the current flow through the cartridge as soon as the main contact is opened, which prevents formation of an arc. When the vacuum cartridge is in turn opened, the circuit is interrupted in reliable manner, as the arc is extinguished immediately in the vacuum of the cartridge.

The operating mechanism via which the vacuum cartridge is opened is advantageously actuated by the movable contact itself during a part of the opening travel of the latter so that the operator has a single command to perform and so that opening of the vacuum cartridge is synchronized with that of the main circuit with a very small time lag. The documents U.S. Pat. No. 5,168,139, FR-A-2,721,434 and FR-A-2,937,786 describe vacuum cartridges or switches comprising the above.

Various operating mechanisms have already been proposed in the prior art, but they present a certain complication which implies an economic drawback and may reduce their reliability. One of the reasons is that the main movable contact performs a reverse trajectory when closing the electric circuit, and that it therefore intercepts the operating device as it had done during opening of the circuit, which is not possible without precautions being taken, as the operating device, which is generally biased to an invariable state by a spring, does not have a reversible operation. Interception during reclosing of the circuit is therefore prevented by retraction of the main contact or of the operating device, for example by constructing the latter with a unidirectional pivot (as in the third document above), which complicates the switch and may be detrimental to its dependability.

SUMMARY OF THE INVENTION

One object of the invention is therefore to simplify such switches and/or circuit breakers, more generally electric switchgear devices, in particular medium-voltage devices.

In a general form, the invention relates to a device in particular suitable for breaking medium voltages, having a vacuum cartridge branch-connected on a main electric circuit principal able to be opened or closed by a main movable contact, the vacuum cartridge having a rod passing through an enclosure and supporting a movable contact of said vacuum cartridge, the switch further comprising an operating mechanism of the vacuum cartridge actuated by the main contact and actuating the rod and comprising a rotating rocker arm connecting the rod and the main movable contact. The rocker arm is rigid and comprises two articulation regions around which it respectively rotates during the opening and closing operations of the main electric circuit.

The known complex rocker arm, composed of two parts articulated on one another, is therefore replaced by a unitary rocker arm fitted with flexibility, without fixed articulation points. The use of an articulation which could be qualified as oscillating between two fixed points in the direction of rotation of the rocker arm enables it to fully intercept the main movable contact in one direction and to be moved by the latter, but without retracting in front of the latter in the other direction of movement.

In most embodiments, the mechanism also comprises a spring biasing the rod to an invariable state, which can be connected for example to a fixed structure of the switch or rocker arm, or between the enclosure and the rod of the vacuum cartridge.

In an important design, the rocker arm is articulated on the rod in one of said articulation regions. In the other of said articulation regions, the operating mechanism can then comprise a fixed pin and a portion of the rocker arm provided with an oblong aperture in which the pin moves when the rocker arm rotates around said one of the articulation regions. In another design, the rod is rigidly fixed to the rocker arm and is flexible. The articulation regions are then advantageously contact points of the rocker arm with fixed parts of the switch, the rocker arm being only connected to the rod in a state in which it is not biased by the main movable contact. Said fixed parts of the switchgear device can belong to a sleeve fixed to the vacuum cartridge and surrounding the rod, and are located on each side of the rod.

Electric conduction through the branch-off to the vacuum cartridge can be procured by the rocker arm, or possibly by a conducting switching tab electrically connected to the movable contact of the vacuum cartridge and extending up to a free end approximately superposed on a free end of the rocker arm which intercepts the main movable contact, the main movable contact rubbing on the free end of the switching tab.

When this tab exists, the rocker arm can also rub on the switching tab with a greater resistance than the force exerted by the biasing spring. This design enables two stable states of the switch to be established at will in different positions of the rocker arm in the absence of biasing by the main movable contact.

The main movable contact can also be rotating or sliding.

BRIEF DESCRIPTION OF THE DRAWINGS

Some embodiments of the invention will now be described for purely illustrative purposes only in connection with the following figures.

DETAILED DESCRIPTION OF A PREFERRED EMBODIMENT

Figure 1:
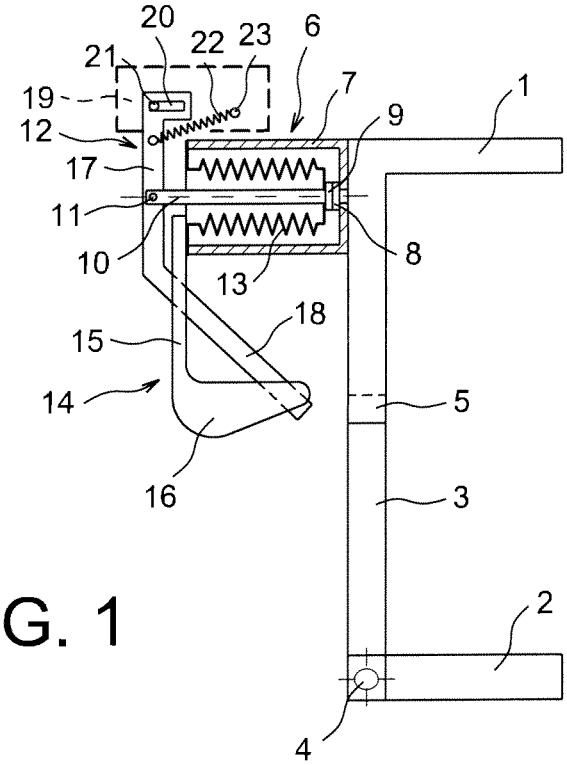
FIGS. 1, 2, 3, 4, 5, 6 and 7 illustrate a first embodiment of the invention and various steps of opening and closing of the circuit.

As described in FIG. 1, the switchgear device, here a switch, comprises a main circuit composed of a line-side stationary contact (1), a load-side stationary contact (2), and a main movable contact (3) connected to the load-side stationary contact (2) by an articulation (4) and having a free end (5) to be connected with the free end of the line-side stationary contact (1) to establish a closed state of the circuit, represented in this FIG. 1. The vacuum cartridge (6) forms a branch-off of the main circuit. It comprises an enclosure (7), a stationary contact (8) electrically connected to the line-side stationary contact (1) via the enclosure (7), a movable contact (9) present in the enclosure (7), located at the end of a rod (10) the opposite end of which extends outside the enclosure (7) forming an articulation and also with a rocker arm (12), and the movable contact (9) touches the stationary contact (8) in the closed state of the vacuum cartridge (6), represented here. The tightness of the inside of the enclosure (7) is preserved by a bellows (13) surrounding the rod (10), one end of which is sealed against a rim of the enclosure (7) and the other end of which is adjusted with clamping on the rod (10) close to the movable contact (9).

A switching tab (14) comprises a shaft (15) extending in parallel direction to the end of the line-side stationary contact (1) from the end of the bellows (13), which it touches, up to in front of the free end (5) of the main movable contact (3), and an enlarged end in the form of a spatula (16) which extends from the shaft (15) perpendicularly thereto towards this free end (5) at a short distance therefrom. The rocker arm (12) also comprises two portions (17 and 18) forming an angle between them, the first of which, which extends in front of the end of the enclosure (7), supports the articulation (11), an attachment pin of a spring (22) drawn between the rocker arm (12) and a point (23) of a fixed structure (19) of the switch, and an aperture (20) in which a pin (21) also belonging to the fixed structure (19) slides. The second portion (18) extends in front of the switching tab (14), and their free ends are more or less aligned perpendicularly to the plane of the figure and of the main circuit, in the represented closed state of the vacuum cartridge (6). The switching tab (14) and rocker arm (22) can be in contact by friction or not.

Figure 2:
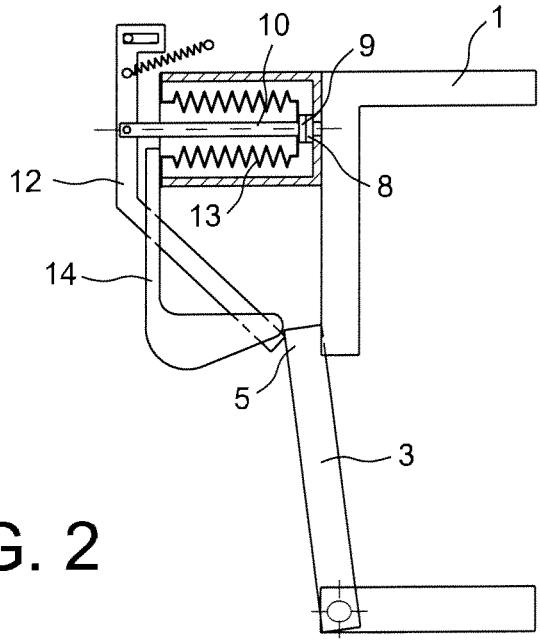

As illustrated in FIG. 2, opening of the electric circuit is performed by rotation of the main movable contact (3) by means of a handle, not represented, and overlapping with the line-side stationary contact (1) ceases little by little. The main movable contact (3) does however reach the end of the rocker arm (12) beforehand, so that the electric current is directed little by little through the branch-off occupied by the vacuum cartridge (6), which prevents creation of an electric arc between the contacts (1, 3). Electric conduction is performed by contacts (8 and 9), rod (10), and rocker arm (12) if all the parts are conductive. It can also be performed via the contacts (8, 9), the bellows (13) which then has to be conductive, and the switching tab (14) if the latter rubs on the rocker arm (12) or the main movable contact (3).

Figure 3:
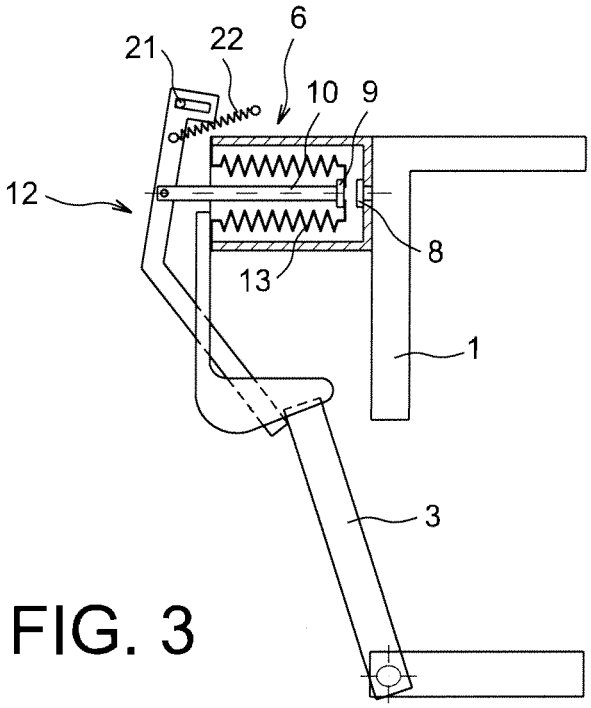
Figure 4:
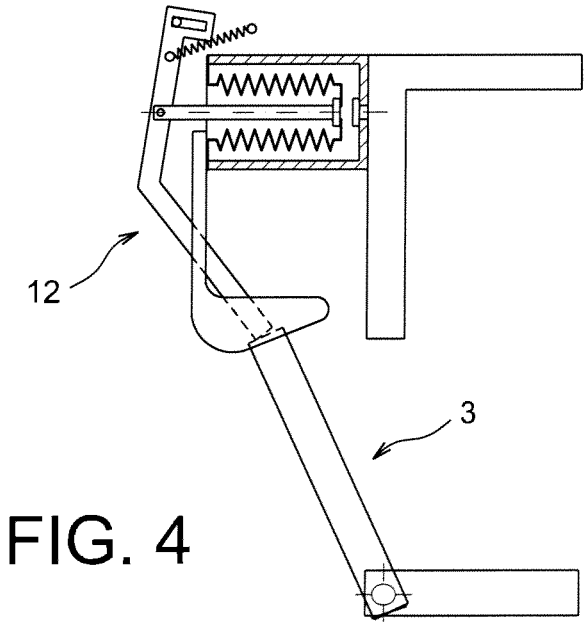
Figure 5:
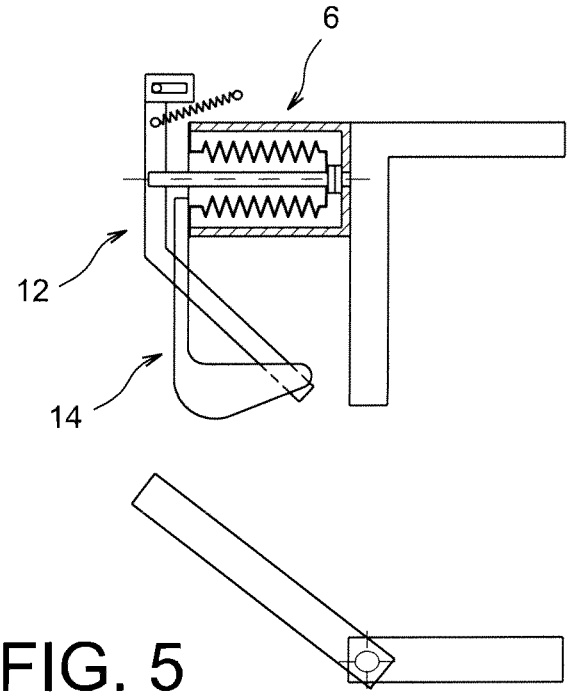
Figure 6:
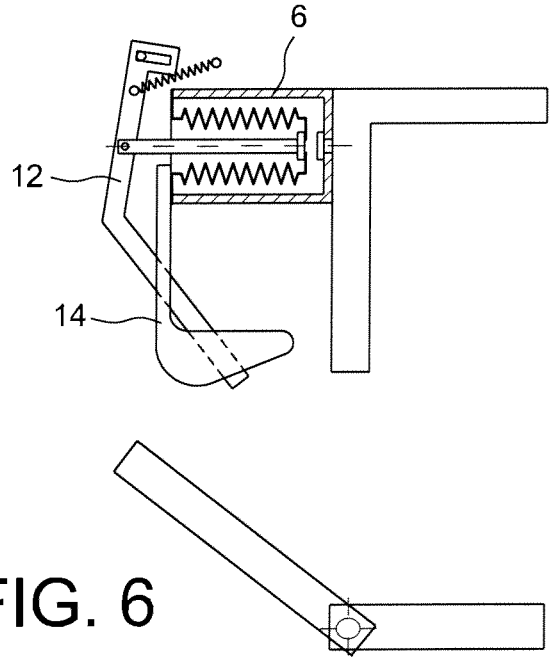

The step of FIG. 3 represents opening of the switch, the main movable contact (3) is completely separated from the line-side stationary contact (1), and it has started to repel the rocker arm (12), which is however retained at its opposite end by the spring (22), so that it swivels around the pin (21). The rod (10) is pulled and separates the movable contact (9) from the stationary contact (8). The electric current is then interrupted in the vacuum cartridge (6). When rotation of the main movable contact (3) is continued, the end of the rocker arm (12) escapes from the main movable contact (3) (FIG. 4) and can return to its place reclosing the vacuum cartridge (1) (FIG. 5), the circuit remaining open. It is however possible, according to an alternative embodiment represented in FIG. 6, for friction between the rocker arm (12) and the switching tab (14) to maintain the latter in the position to which the main movable contact (3) repelled it, keeping the vacuum cartridge (6) open, which can improve disconnection.

Figure 7:
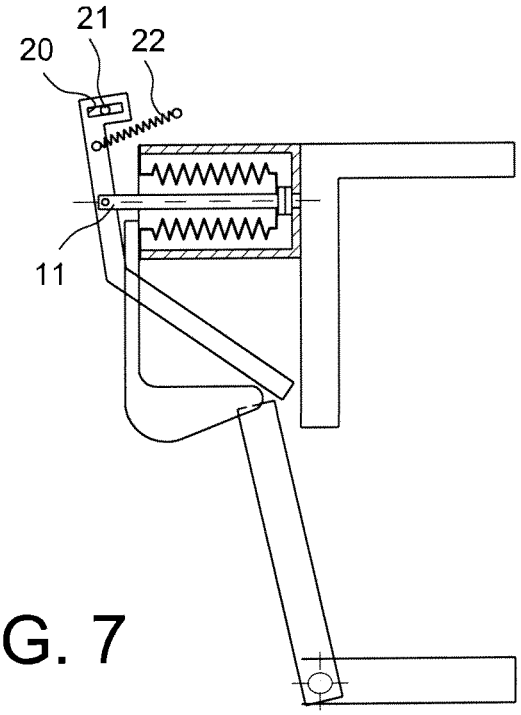

FIG. 7 illustrates reclosing of the circuit. The main movable contact (3) is moved in the reverse direction, passes in front of the switching tab (14) rubbing on the latter or not and intercepts the end of the rocker arm (12) making the latter rotate in the opposite direction. When the contacts (8, 9) touch, the rod (10) however remains immobile and rotation of the rocker arm (12) continues around the articulation (11) which remains immobile. The spring (22) is then taut and the rocker arm (12) moves in front of the pin (21) which slides in the oblong aperture (20). This continues until the rocker arm (12) escapes from interception of the free end (5). The switch then reverts to the state of FIG. 1.

Figure 8:
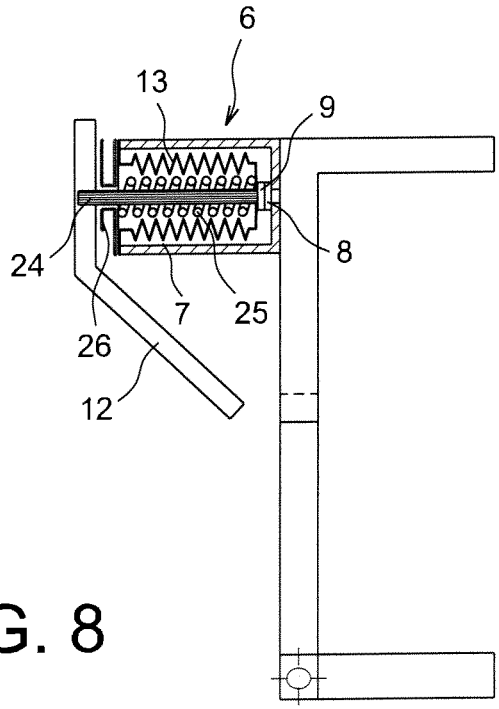
FIGS. 8, 9 and 10 likewise illustrate another embodiment of the invention.

In another embodiment (FIG. 8), the switching tab (14) is absent, as are the pin (21), aperture (20), and articulation (11). The rocker arm (12) however remains united to the rod—now (24)—of the vacuum cartridge (6), which consists of a conductive rod having a certain flexibility and which is embedded in the rocker arm (12). A spring (25) is positioned around the rod (24) inside the bellows (13) and biases the contacts (8, 9) to the closed position. A sleeve (26) is finally established outside the enclosure (7) of the vacuum cartridge (6), around the rod (24) and stops at a short distance from the rocker arm (12).

Figure 9:
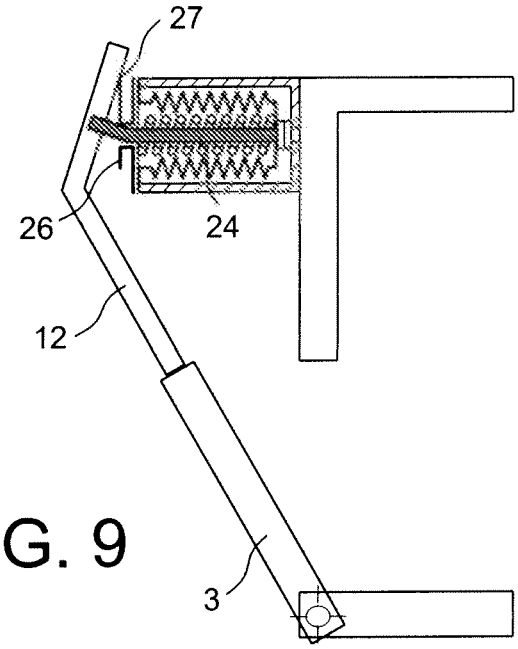

Opening of the circuit starts as in the above by rotation of the main movable contact (3) (FIG. 9), which is intercepted by the free end of the rocker arm (12). Movement of the rocker arm (12) takes place by pulling the rod (24) against the spring (25), by curving it somewhat on account of the rotation inflicted upon it by the main movable contact (3), and a pivoting point (27) finally appears by contact of one end of the rocker arm (12) with a portion of the sleeve (26). But the rocker arm (12) reverts to its place due to the flexibility of the rod (24) of the spring (25) when the main movable contact (3) has overshot the latter.

Figure 10:
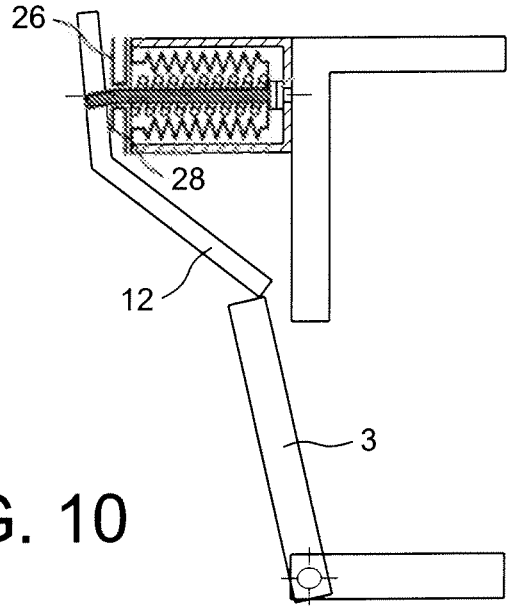

Reclosing of the circuit is illustrated in FIG. 10. The main movable contact (3) makes the rocker arm (12) swivel in the opposite direction, again producing a flexion of the rod (24), in the opposite direction, and another pivoting point (28) forms between the rocker arm (12) and the sleeve (26), opposite from the previous point (27) on the sleeve (26). The contacts (8, 9) can be slightly separated.

Figure 11:
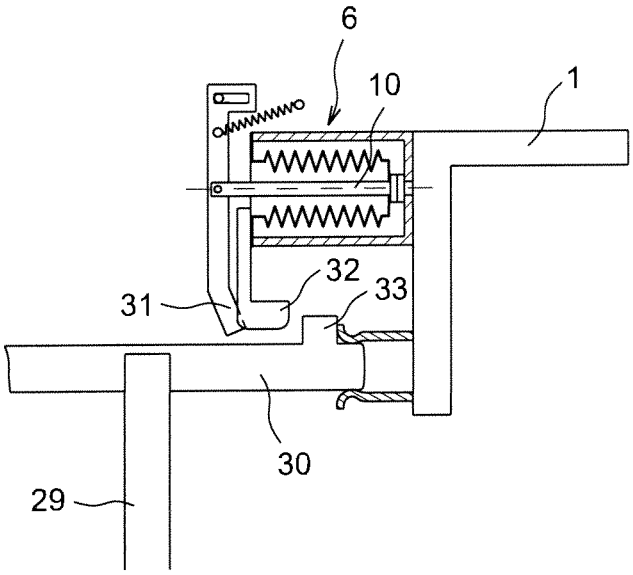
FIGS. 11, 12, 13, 14, 15 and 16 illustrate a third embodiment of the invention.

In another embodiment (FIG. 11), the main movable contact—now (30)—is movable in translation and runs on the load-side stationary contact (29) in the course of its movement. The vacuum cartridge (6) and the operating device are approximately identical to the first embodiment, with the exception that the ends of the rocker arm—now (31)—and of the switching tab—now (32)—have modified proportions to take account of the interception with the main movable contact (30). The latter extends in a direction parallel to the rod (10), moves in this direction, and intercepts the rocker arm (31) and switching tab (32) by means of a protrusion (33) provided thereon.

Figure 12:
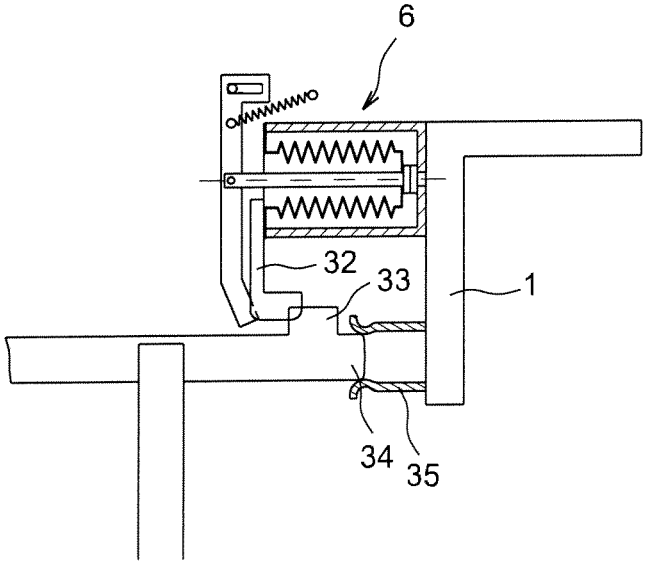
Figure 13:
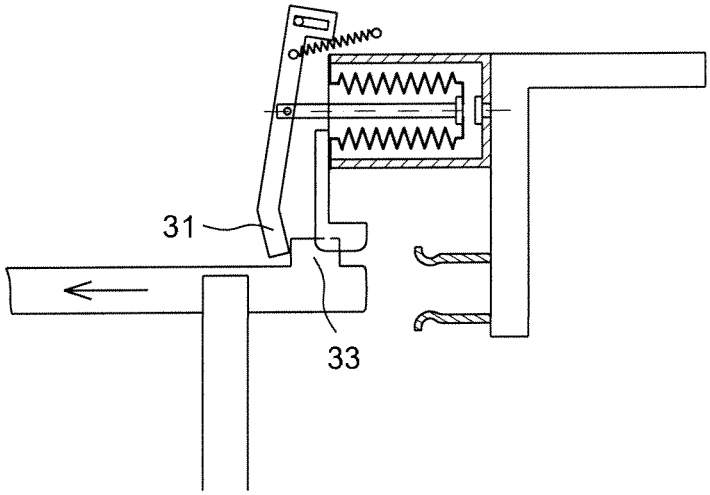
Figure 14:
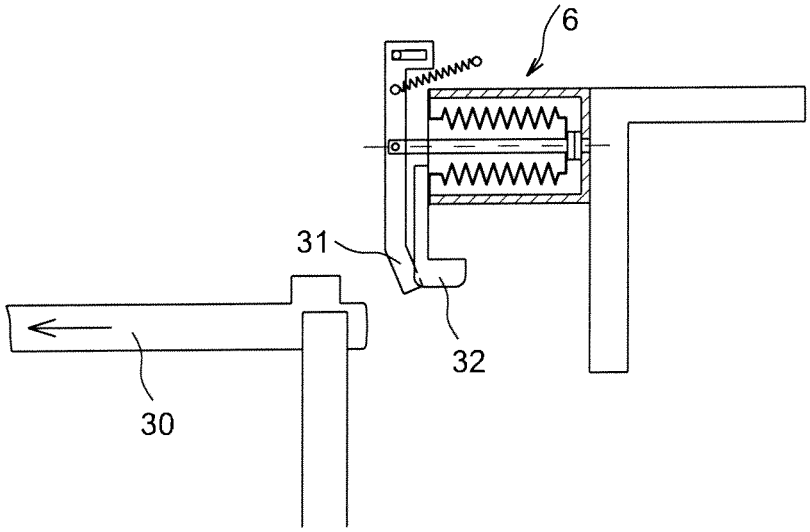
Figure 15:
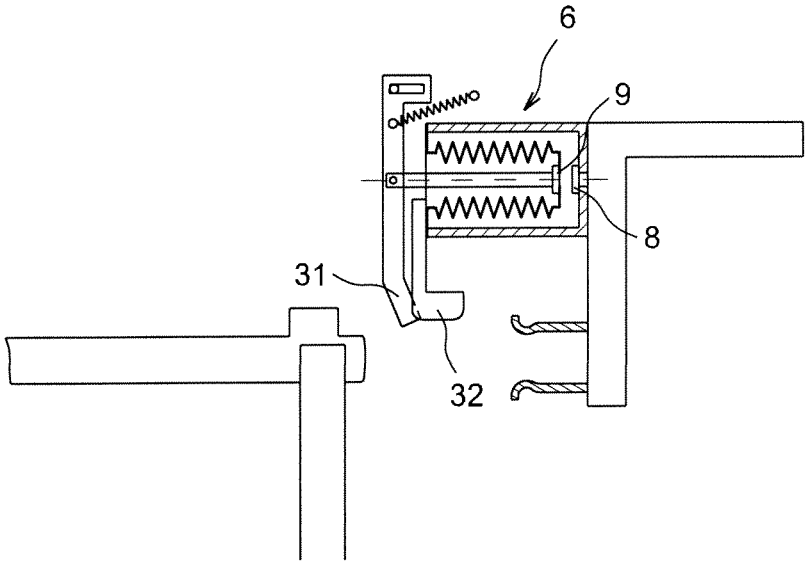
Figure 16:
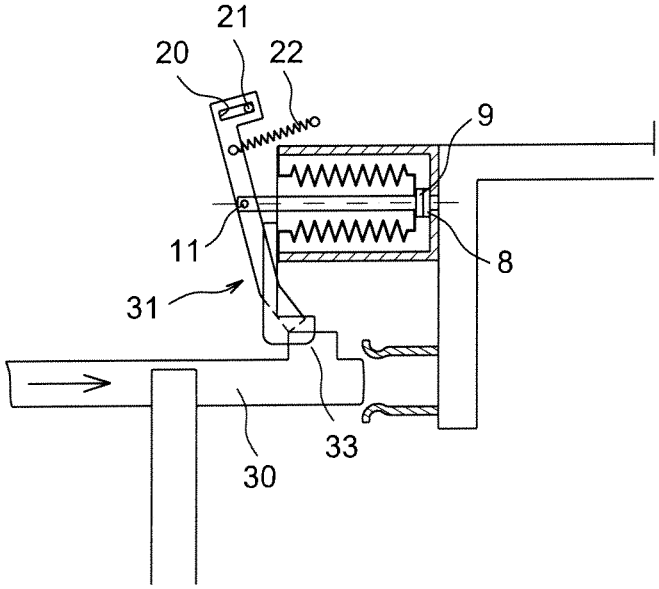

FIG. 12 illustrates the beginning of opening of the circuit. One end (34) of the main movable contact (30) little by little leaves a collar (35) electrically connected to the load-side stationary contact (1), whereas the protrusion (33) slides against the end of the switching tab (32) and little by little transfers the current into the branch-off of the vacuum cartridge (6). FIG. 13 illustrates disconnection of the main circuit and opening of the vacuum cartridge which takes place shortly afterwards, the protrusion (33) pushing the end of the rocker arm (31). When opening of the circuit is complete, the rocker arm (31) has thus been rotated to escape from the protrusion (33) and has returned to its place (FIG. 14), or (FIG. 15) on the contrary has not completely returned to its place but keeps the contacts (8 and 9) open, due to a friction occurring between the latter and the switching tab (32). When the circuit is reclosed, the main movable contact (30) makes the rocker arm (31) rotate in the other direction and therefore, as in the first embodiment, forces movement of the pin (21) in the aperture (20) consecutive to swiveling of the rocker arm (31) around the pin (30), the contacts (8 and 9) being kept closed, tensing the spring (22). When the protrusion (33) has moved beyond the rocker arm (31) in the closing direction, the switch reverts to the state of FIG. 11.

The invention claimed is:

1. A current breaking device suitable for medium voltages, and comprising:

a main stationary contact (1);

a vacuum cartridge (7) connected to and extending from said main contact, having an actuating rod (10) extending through an enclosure (6) and supporting a second movable contact (9) for closing connection with, and opening disconnection from, a second stationary contact (8) connected to said main contact;

a main movable contact (3) for closing connection with, and opening disconnection from, said main stationary contact; and a rigid rocker arm (12) pivotally connected about one axis (11) directly to one end of the actuating rod (10) of the vacuum cartridge, and at directly about another axis (21) fixed with respect to the main stationary contact and vacuum cartridge, so that the rocker arm is partially rotatable about both said axes;

wherein upon rotation of said rocker arm in a direction for opening both said main and second contacts, said main contacts are opened before said second contacts are fully opened, and upon rotation of said rocker arm in an opposite direction for closing both said second and main contacts, said second contacts are fully closed before any movement of said main contacts toward closure.

2. The current breaking device according to claim 1, additionally comprising a spring biasing the rod in the direction of closure of the second contacts.

3. The current breaking device according to claim 2, wherein one end of the spring is connected to the rocker arm.

4. The current breaking device according to claim 2, wherein the spring is between the enclosure and the rod of the vacuum cartridge.

5. The current breaking device according to claim 1, wherein, the another axis comprises a fixed pin, and a portion of the rocker arm includes an oblong aperture which fits over the pin and permits the rocker arm to rotate around said another axis.

6. The current breaking device according to claim 1, wherein the vacuum cartridge comprises a fixed sleeve surrounding the rod.

7. The current breaking device according to claim 1, wherein the contact between the rocker arm and the main movable contact is achieved either by friction or by articulated grips.

8. The current breaking device according to claim 2, further comprising a conductive switching tab, electrically connected to the movable contact of the vacuum cartridge, and extending to a free end contiguous a free end of the rocker arm which intercepts the main movable contact, whereby contact between the rocker arm and the main movable contact is achieved either by friction or by articulated grips.

9. The current breaking device according to claim 1, wherein the main movable contact is rotatable.

10. The current breaking device according to claim 1, wherein the main movable contact is slidable.

11. A current breaking device suitable for medium voltages, and comprising:

a main stationary contact (1);

a vacuum cartridge (6) connected to and extending from said main contact (1), having a flexible actuating rod (24) extending through an enclosure and supporting a second, movable contact (9) for closing connection with, and opening disconnection from, a second, stationary contact (8) connected to said main contact (1);

a main movable contact (3) for closing connection with, and opening disconnection from, said main stationary contact (1); and a rigid rocker arm (12) connected to one end of the actuating rod (24) of the vacuum cartridge, in an articulated manner for rotation on one hand around a first axis (26) and on the other hand around a second axis (27), both axes being fixed with respect to the main stationary contact (1) and vacuum cartridge (6), said rocker arm being pivotable about said second axis (27) during opening of said contacts, and about said first axis (26) during closing of said contacts, so that upon rotation of said rocker arm in a direction for opening both said main and second contacts, said main contacts are opened before said second contacts are fully opened, and upon rotation of said rocker arm in an opposite direction for closing both said second and main contacts, said second contacts are fully closed before any movement of said main contacts toward closure.

12. The current breaking device according to claim 11, wherein said main movable contact may contact and bias an end of the rocker arm, but the rocker arm is connected only to the rod when the rocker arm is not biased by the main movable contact.

* * * * *